US010532473B2

(12) United States Patent
Krauss et al.

(10) Patent No.: US 10,532,473 B2
(45) Date of Patent: Jan. 14, 2020

(54) ELECTRIC SHAVER

(71) Applicant: Braun GmbH, Kronberg (DE)

(72) Inventors: Joachim Krauss, Seeheim-Jugenheim (DE); Detlef Gleich, Friedrichsdorf (DE); Wolfgang Stegmann, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 5 days.

(21) Appl. No.: 15/716,882

(22) Filed: Sep. 27, 2017

(65) Prior Publication Data

US 2018/0085941 A1 Mar. 29, 2018

(30) Foreign Application Priority Data

Sep. 28, 2016 (EP) ..... 16191119
Sep. 26, 2017 (EP) ..... 17193125

(51) Int. Cl.
*B26B 19/04* (2006.01)
*B26B 19/38* (2006.01)
(Continued)

(52) U.S. Cl.
CPC ..... *B26B 19/048* (2013.01); *B26B 19/046* (2013.01); *B26B 19/386* (2013.01);
(Continued)

(58) Field of Classification Search
CPC ... B26B 19/048; B26B 19/046; B26B 19/146; B26B 19/042; B26B 19/386; B26B 19/282; B26B 19/145
See application file for complete search history.

(56) References Cited

U.S. PATENT DOCUMENTS 6,226,871 B1 * 5/2001 Eichhorn ..... B26B 19/048 30/346.51
8,028,418 B2 * 10/2011 Sagawa ..... B26B 19/048 30/34.1
(Continued)

FOREIGN PATENT DOCUMENTS

DE 20 2015 103 618 U1 * 7/2015
DE 202015103618 7/2015
(Continued)

OTHER PUBLICATIONS

European search report dated May 17, 2017.

*Primary Examiner* — Hwei-Siu C Payer
(74) *Attorney, Agent, or Firm* — Kevin C. Johnson

(57) ABSTRACT

The present invention relates to an electric shaver. More particularly, the present invention relates to an electric shaver comprising a handle and a shaver head including at least one cutter unit having a drivable cutter element and a shear foil, wherein the shaver head is connected to the handle by means of a support structure which in some cases may provide for some movability of the shaver head relative to the handle. The shaver head and/or the at least one cutter unit may have an elongated contour with a main axis extending transverse to the handles' longitudinal axis and substantially parallel to a cutting oscillation axis of the cutter element. The shaver head is spaced apart from the handle with a gap defined between a bottom face of the shave head and a top face of the handle, the gap forming a ring-shaped contraction in the outer contour of the shaver around the support structure and giving access to the support structure bridging the gap.

15 Claims, 6 Drawing Sheets

(51) Int. Cl.
*B26B 19/28* (2006.01)
*B26B 19/14* (2006.01)

(52) U.S. Cl.
CPC ..... *B26B 19/042* (2013.01); *B26B 19/145* (2013.01); *B26B 19/146* (2013.01); *B26B 19/282* (2013.01)

(56) References Cited

U.S. PATENT DOCUMENTS 8,819,946 B2 9/2014 Yamasaki et al.
9,399,302 B2 * 7/2016 Shimizu ..... B26B 19/048
2004/0231160 A1 11/2004 Shiba et al.
2005/0138821 A1 * 6/2005 Tsushio ..... B26B 19/048 30/527
2008/0034591 A1 2/2008 Fung
2009/0241343 A1 * 10/2009 Yamasaki ..... B26B 19/048 30/43.92
2010/0175262 A1 * 7/2010 Shigeta ..... B26B 19/048 30/43
2010/0180448 A1 * 7/2010 Sato ..... B26B 19/046 30/43.92
2011/0094107 A1 4/2011 Ring et al.
2018/0085937 A1 * 3/2018 Erndt ..... B26B 19/046
2018/0085941 A1 * 3/2018 Krauss ..... B26B 19/048
2018/0085948 A1 * 3/2018 Krauss ..... B26B 19/048
2018/0085949 A1 * 3/2018 Krauss ..... B26B 19/048
2018/0085954 A1 * 3/2018 Krauss ..... B26B 19/046

FOREIGN PATENT DOCUMENTS

EP 1547735 6/2005
EP 1886775 2/2008
EP 3 305 485 A1 * 4/2018

* cited by examiner

ELECTRIC SHAVER

FIELD OF THE INVENTION

The present invention relates to an electric shaver. More particularly, the present invention relates to an electric shaver comprising a handle and a shaver head including at least one cutter unit having a drivable cutter element and a shear foil, wherein said shaver head is connected to said handle by means of a support structure which in some cases may provide for some movability of the shaver head relative to the handle. Said shaver head and/or said at least one cutter unit may have an elongated contour with a main axis extending substantially transverse to the handle's longitudinal axis and substantially parallel to a cutter oscillation axis of said cutter element.

BACKGROUND OF THE INVENTION

Electric shavers usually have one or more cutter elements driven by an electric drive unit in an oscillating manner where the cutter elements reciprocate under a shear foil, wherein such cutter elements or undercutters may have an elongated shape and may reciprocate along their longitudinal axis. Other types of electric shavers use rotatory cutter elements which may be driven in an oscillating or a continuous manner. Said electric drive unit may include an electric motor or a magnetic-type linear motor, wherein the drive unit may include a drive train having elements such as an elongated drive transmitter for transmitting the driving motion of the motor to the cutter element, wherein said motor may be received within the handle portion of the shaver or in the alternative, in the shaver head thereof.

Irrespective of the architecture of the drive unit and the drive train, the cutter elements, in addition to the aforementioned cutting motion, may be movable in other directions so as to self-adapt to the contour of the skin to be shaved. For example, the cutter elements may be part of a shaver head that is slewable about one or more axes relative to the handle of the shaver, wherein the support structure connecting the shaver head to the handle may allow the shaver head to swivel about a swivel axis extending substantially parallel to the elongated cutter elements and/or the reciprocating axis thereof. In addition or in the alternative, the supporting structure may allow the shaver head to tilt about a tilting axis extending transverse to the longitudinal axis of the handle and transverse to the elongated cutter elements and/or the reciprocating axis thereof. In addition to or in the alternative to such shaver head movements, the cutter elements may dive into the shaver head and/or the shaver head may dive towards the handle so as to adjust the position relative to the skin contour to be shaved.

The support structure connecting the shaver head to the handle may have different configurations so as to allow for the aforementioned swiveling and/or tilting movements and to avoid collisions with the drive train extending from the drive unit to the cutter element. For example, the support structure may include a so-called four-joint linkage formed by a pair of link arms which are, on the one hand, pivotably mounted to the handle and, on the other hand, pivotably mounted to a shaver head part such as a shaver head frame, wherein the pivotable joints connecting the link arms to the handle and the shaver head, respectively, may define pivot axes parallel to each other and parallel to the tilting or swiveling axis defined by such four-joint linkage. Due to slewing or rotating movements of the link arms, the shaver head may tilt or swivel to adjust its rotatory position to better follow the skin contour.

Such support structures are sometimes rather difficult to be cleaned. Hair dust or hair stubbles from the cutter elements may get stuck on the support structure and neighboring surfaces and may form a cake or deposits in corners and recesses what may impair the movability of the shaver head.

For example, prior art reference US 2010/0175264 A1 shows such four-joint linkage of the shaver head to the handle, wherein the link arms are arranged in a sort of pendulum or hanging arrangement. An interposer part attached to the handle includes two poles projecting upwards into the shaver head, wherein the link arms are pivotably attached to the top end portions of such poles to extend or hang downwards back towards to the handle. The lower end portions of such hanging link arms are pivotably connected to a shaver head frame.

A similar support structure movably connecting the shaver head of an electric shaver to the handle thereof is shown by reference JP 2016-77464 A also showing a four-joint linkage including a pair of hanging link arms.

Another support structure allowing for swiveling and tilting of the shaver head of an electric shaver about swiveling and tilting axes is shown by EP 2 435 218 B1 suggesting a cardanic support structure including a shaver head frame pivotably mounted to a cradle-like handle part and, on the other hand, pivotably supporting a cutter frame on which the cutter element is supported.

Document US 2008/0034591 A1 discloses an electric shaver with reciprocating cutter elements in the shaver head, wherein said shaver head can be pivoted relative to the handle into various directions by means of a ball joint arranged between the handle and the shaver head. The action of the motor received in the handle is transferred to the cutter element in the head by means of a spring.

Document EP 1547735 A1 shows a shaver with a shaver head pivotably connected to the handle via a four-joint linkage. More particularly, a central support post projects from the topside of the handle into the shaver head, wherein a pair of linkage arms connecting the shaver head to the central support post are accommodated within the shaver head.

Furthermore, AT 409604 B shows an electric shaver having cutter elements which may, in addition to the oscillating cutting movements, pivot about an axis perpendicular to the shaver's longitudinal axis and the axis of oscillation of the cutter element so as to allow for adjustment of the cutter element position to the skin to be shaved, and rotatorily oscillate about an axis parallel to the longitudinal axis of the shaver housing. The transmission train connecting the drive motor to the cutter elements includes a coupling structure rotatorily oscillating about a pivot axis parallel to the shaver housing's longitudinal axis.

US 2009/0025229 A1 discloses a drive unit for the cutter elements of an electric shaver, wherein the drive unit includes transmitter pins extending from the shaver housing towards the shaver head, wherein the oscillating driving movements of said transmitter pins are applied onto the cutter elements via an oscillatory bridge supported for oscillatory reciprocation in the shaver head, wherein said oscillatory bridge includes yielding coupling arms so as to allow for adjusting movements of the cutter elements. A similar transmission architecture is known from U.S. Pat. No. 7,841,090 B2.

Further electric shavers allowing for adapting movements of the cutter elements are known from EP 1886775 A1, DE 20 2015 103 618 U1, EP 1935585 A1, DE 10 2008 031 132 A1, US 2004/231160 A1, U.S. Pat. No. 3,748,371 B, FR 1391957 A, GB 811,207 B and U.S. Pat. No. 5,704,126 B.

SUMMARY OF THE INVENTION

It is an objective underlying the present invention to provide for an improved electric shaver avoiding at least one of the disadvantages of the prior art and/or further developing the existing solutions. A more particular objective underlying the invention is to provide for an improved cleaning of the support structure between the shaver head and the handle to maintain movability thereof.

Another objective is to achieve a more ergonomic, self-explaining handling of the shaver.

A further objective is an improved support structure connecting the shaver head to the handle to allow the shaver head self-adjusting of its position relative to the handle and avoiding collisions with the drive train driving the cutter element without restrictions to the drive train.

A further objective underlying the invention is to allow for a better self-adaption of the angular position of the shaver head to the skin contour to be shaved, including a better responsiveness of self-adjusting swivel and tilt movements of the shaver head to changing skin contours when moving the shaver head along the skin contour to be shaved.

To achieve at least one of the aforementioned objectives, it is suggested to clearly separate the shaver head from the handle and to avoid interpenetrating or interlacing of shaver head portions into the handle and vice versa. More particularly, the shaver head may be positioned spaced apart from the handle with a gap defined between a bottom face of the shaver head and a top face of the handle, said gap forming a peripheral or circumferential contraction in the outer contour of the shaver around said support structure and giving access to the support structure bridging said gap. Due to such open periphery and separation of the shaver head and the handle from each other, air can be blown onto the support structure or water can be rinsed through the gap to clean the support structure and the bottom surface of the shaver head and/or the handle's top face to remove hair particles and deposits. In addition, such spacing between the shaver head and handle increases the degree of freedom of moving the shaver head relative to the handle without the restrictions of collisions between these two elements, wherein such additional freedom is particularly helpful in tilting an elongated shaver head about a tilting axis perpendicular to the main axis of the elongated shaver head. Said gap may form a substantially ring-shaped constriction of the shaver body or a housing gap extending between the handle's housing and the shaver head housing or the outer contour of the shaver head, wherein ring-shaped does not necessarily mean a closed circle, but may include other contours such as an oval or elliptical ring which may or may not be closed or may be slotted. Said substantially ring shaped constriction may surround substantially completely a central neck portion. In other words, the shaver body has a neck formed between the handle and the shaver head clearly separating these two components from each other.

According to an aspect, said support structure around which the peripheral contraction in the shaver's outer contour is formed, may include a four-joint linkage, comprising at least two link arms which are, on the one hand, pivotably connected to the handle or a base part connected to said handle, and, on the other hand, pivotably connected to the shaver head, wherein the pivot axes connecting the link arm to the handle and to the shaver head may extend substantially parallel to each other and substantially transverse to the longitudinal axis of the handle. Such link arms of said four-joint linkage may extend through and bridge said gap, wherein said link arms may be uncovered and freely accessible via said gap between the shaver head and the handle. Such uncovered arrangement making said link arms extending through said gap visible allows for easily cleaning of the link arms to remove hair stubbles and other deposits which could impair movability of those link arms. At the same time, due to visibility of the arms bridging said gap, the function of the pivotable suspension of the shaver head and the self-adaption of the shaver head to the skin contour is demonstrated to a user in a self-explaining way.

According to a further aspect, the four-joint linkage between the shaver head and the handle may allow the shaver head to swivel and/or tilt relative to the handle, wherein said pair of link arms each may have a head joint pivotably connecting to a shaver head part and a handle joint connecting to the handle or a base part connected to such handle.

More particularly, said pair of link arms may be arranged in a standing configuration with the head joints of the link arms connecting to the shaver head part being further away from the handle than the handle joints of the link arms connecting to the handle or base part.

In addition to said support structure, the gap between the separated shaver head and the handle may be bridged by a drive transmitter for driving the at least one cutter element of the shaver head which drive transmitter may be separated from the elements of the support structure. If the support structure includes the aforementioned four-joint linkage with a pair of link arms, said link arms and the drive transmitter may be the only elements bridging the gap between the shaver head and the handle so that three elongated elements are bridging said gap and form a neck connecting the handle to the shaver head.

These and other advantages become more apparent from the following description giving reference to the drawings and possible examples.

DETAILED DESCRIPTION OF THE INVENTION

Figure 1A:
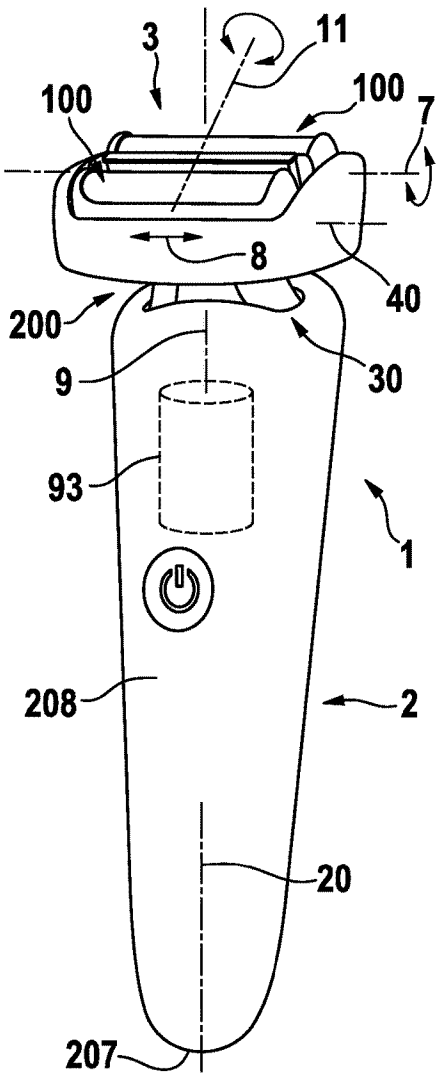
FIG. 1*a*: shows a perspective view of an electric shaver with a shaver head separated and spaced apart from a handle.
Figure 1B:
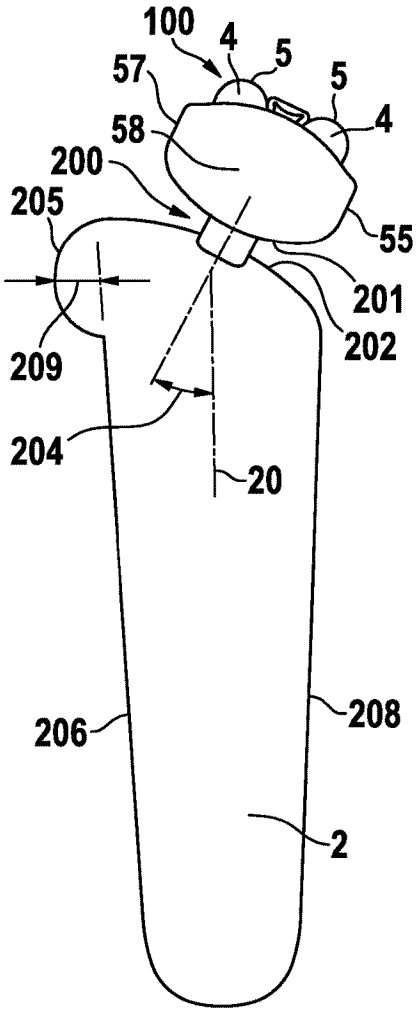
FIG. 1*b*: shows a side view of said shaver shown in FIG. 1(*a*)
Figure 1C:
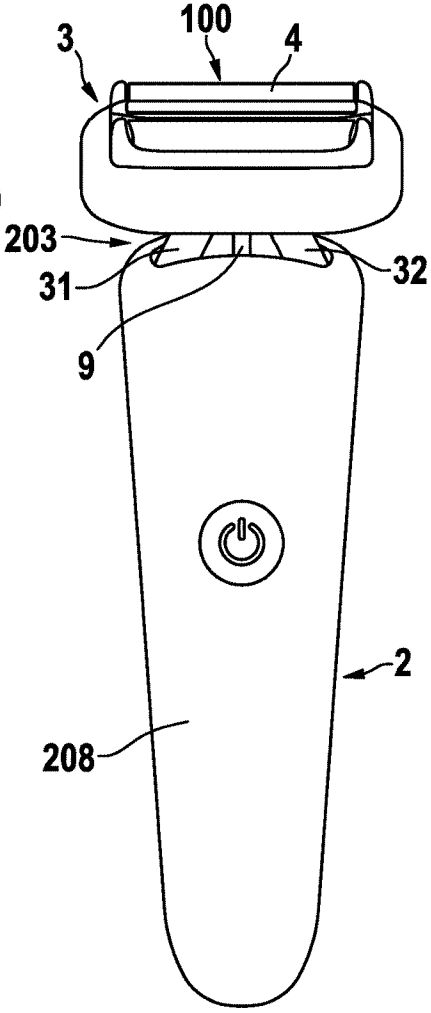
FIG. 1*c*: shows a front view of said shaver shown in FIG. 1(*a*)
Figure 1D:
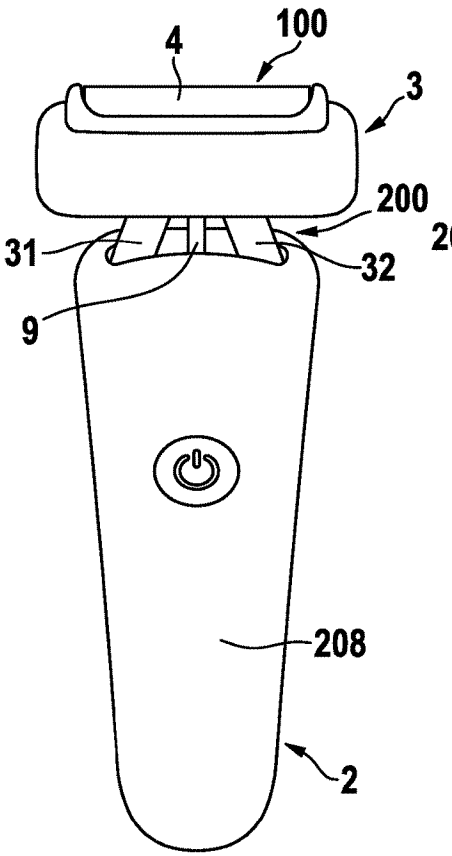
FIG. 1*d*: shows a front view of said shaver shown in FIG. 1(*a*), but along a viewing axis not perpendicular to the handle's longitudinal axis but perpendicular to the drive shaft's longitudinal axis which slightly inclined to the handle's longitudinal axis, thus better showing the housing's constriction between the handle and the shaver head.

In order to allow for easier cleaning and better maintenance of the support structure, the shaver head has been moved away from the handle and positioned spaced apart therefrom so that a gap is formed between the shaver head's bottom face and the handle's top face which are facing each other, so that when, considering the shaver in its entirety, the outer contour of the shaver is provided with a significant, substantially ring-shaped contraction between the shaver head and the end of the handle adjacent thereto, which contraction surrounds the aforementioned support structure which may be positioned in a center region of the handle's top face and the shaver head's bottom face. Said gap may form a housing gap significantly constricting the shaver body to form a neck and separating the handle housing from the shaver head housing. Due to such contraction and the aforementioned gap, substantially the entire bottom face of the shaver head and substantially the entire top face of the handle are uncovered and can be visible from the ambience. Contrary to previous shaver head designs where shaver head parts were penetrating into recesses in the handle or into the interior thereof and handle parts were interpenetrating into the shaver head, the separated bottom face of the shaver head and the top face of the handle can be more easily cleaned due to removal of such interpenetrating or interlacing parts. Moreover, the bottom face of the shaver head and the top face of the handle can have a smooth contour substantially without pockets or projections or edges and corners, thereby avoiding hair dust deposits on the shaver head's bottom face and the handle's top face.

A neck between the shaver head and the handle, which neck may include the aforementioned support structure and possibly a drive transmitter, may have a cross-sectional area significantly smaller than the cross-sectional area of the shaver head and the cross-sectional area of the handle. For example, when considering a cross-sectional plane transverse to a longitudinal axis of the handle, the neck's cross-sectional area may be smaller than 50% or smaller than 30% or even smaller than 20% of the cross-sectional area of the handle and/or of the cross-sectional area of the shaver head.

The spacing between the shaver head's bottom face and the handle's top face may vary depending on where it is measured. According to another aspect, said gap, at its smallest section, may have a width of more than 3 mm or more than 5 mm or more than 10 mm, wherein said width corresponds to the distance of the bottom face of the shaver head from the top face of the handle. In particular, such width may be measured along an axis parallel to the handle's longitudinal axis, i.e. the aforementioned distance between the shaver head's bottom face and the handle's top face may be considered to be substantially parallel to the handle's longitudinal axis.

The aforementioned top face of the handle and the bottom face of the shaver each may have a convex, in particular dome-shaped contour and may be positioned relative to each other such that the aforementioned smallest width of the gap between the handle and the shaver head may be positioned in a center region of those top and bottom faces, for example close to a central longitudinal axis through the handle. Said width of the gap and/or the distance between the handle's top face and the shaver head's bottom face may continuously increase towards an outer periphery of these top and bottom faces. Such dome-shaped contour providing for a gap width decreasing towards the center of the shaver helps in cleaning the support structure and the inner portions of the top and bottom faces in a manner similar to a funnel increasing speed of blowing air or rinsing water.

In order to provide for an improved ergonomic handling of the shaver, the shaver head may have a functional surface inclined towards a front side of the handle at an acute angle to the longitudinal axis of the handle, wherein said acute angle may vary. For example, said acute angle may range from 45° to 85° or, for example, from 55° to 80°. Such inclination makes it easier to hold the shaver with said functional surface parallel to the skin to be shaved without angling the hand or the arm in a non-natural position. The aforementioned functional surface is the shaver head's surface where the at least one cutter unit is positioned, wherein, for example, a pair of such elongated cutter units may be positioned parallel to each other on such functional surface. Additional functional elements such as a long hair cutter and/or a cooling element and/or a lubrication element also may be positioned on such functional surface, wherein, for example, a long hair cutter may be positioned between a pair of cutting units or along a side thereof.

The aforementioned front side of the handle, towards which the shaver head, with its functional surface, is inclined, may be considered to be side of the handle which remains open or untouched when the handle is grabbed by hand and/or which faces the user grabbing and watching the shaver. Usually, at least one operating key such as an on/off key or switch may be positioned on such front side of the handle.

So as to allow for ergonomic grabbing of the handle and self-explaining the positioning of the handle in the grabbing hand, the handle may have a swelling projecting transverse to the handle's longitudinal axis from a backside of the handle at an end portion thereof adjacent to the top face of the handle. Said backside may be the handle side opposite to a handle side where the shaver's power switch is positioned and/or the handle side touching the fingers and/or the palm or inside surface of a hand grabbing the handle. Such swelling or projection may have a smooth convex contour and/or may extend substantially transverse to the handle's longitudinal axis across the backside of the handle so as to snuggly fit onto the forefinger and/or the edge of the metacarpus adjacent thereto.

In the region of such swelling, the cross-section of the handle in a cross-sectional plane transverse to the handle's longitudinal axis may be larger than the cross-section of the handle in a handle portion neighboring such swelling, by at least 10% or at least 20% in terms of the cross-sectional area. In the alternative or in addition, the swelling may project from the contour of a handle section neighboring the swelling, by a projecting distance ranging from 3 mm to 20 mm or from 5 mm to 15 mm.

When considering the handle in its entirety, the handle may have an elongated shape the cross-section of which may at last substantially continuously increase from a bottom face of the handle to a top face of the handle opposite to said bottom face of the handle. "Substantially continuously" does not exclude some portions such as a display portion or an operating key portion where the cross-section does not increase. Nevertheless, when considering the larger proportions, the handle's cross-section may increase from a bottom end portion to a top end portion. In other words, the cross-section of the handle may continuously increase towards the shaver head. The cross-sectional shape may vary, wherein such cross-sectional shape may be substantially rounded and/or circular and/or elliptical and/or oval.

In order to further improve ergonomics of the shaver and/or to allow for self-adjusting of the shaver head to the contour of the skin to be shaved, the support structure connecting the shaver head to the handle may be configured to allow for adjusting movements of the shaver head relative to the handle. In particular, the support structure may be configured to allow for slewing movements of the shaver head about at least one axis of rotation relative to the handle. For example, the support structure may be configured to provide for a tilting axis and/or a swiveling axis extending essentially perpendicular to the longitudinal axis of the handle so that the shaver head may tilt and/or swivel relative to the handle.

According to an aspect, the support structure may include a four-joint linkage comprising at least two link arms which are, on the one hand, pivotably connected to the handle or a base part connected to the handle, and, on the other hand, pivotably connected to the shaver head, wherein the pivot axis connecting the link arms to the handle and the shaver head, respectively, may extend substantially parallel to each other and substantially transverse to the longitudinal axis of the handle and/or of a shaft of the drive train for driving the cutter unit. Transverse does not necessarily mean exactly perpendicular in a mathematical sense, but may be considered to mean at least roughly perpendicular such as 90°±25° or 90°±15°.

For example, the link arms of the four-joint linkage may be arranged, when considering the shaver head in its neutral or non-rotated position, in a pitch roof-like or A-configuration where each of the link arms is slightly inclined towards a center plane containing the longitudinal axis of the handle and/or a center plane in the middle between the handle joints of the link arms and extending in parallel to the pivot axis going through such handle joints of the link arms. For example, the elongated link arms, with their longitudinal axis, may extend at an acute angle ranging from 5° to 45° or from 10° to 25° to such center plane, whereas, however, other configurations are possible.

According to another aspect, the distance between the handle joints of the link arms may be larger than the distance between the head joints of the link arms, wherein the difference in the distances can be chosen differently. For example, the distance between the handle joints may be in the range from 105% to 200% or from 120% to 150% of the distance between the head joints, wherein, however, such difference in distances may vary with the length of the link arms.

Irrespective of the difference in distances between the handle points and head points of the link arms, the length of the link arms may be chosen rather short so as to allow for a compact arrangement of the shaver head relative to the handle. In particular, so as to combine a compact arrangement with a high stability of the support structure, the link arms each may have a length that is shorter than the distance between the handle joints of the link arms and/or shorter than the distance between the head joints of the link arms.

The aforementioned link arms may be uncovered and/or freely accessible via said gap between the shaver head and the handle. Such uncovered arrangement allows for easy cleaning of the link arms to remove hair stubbles and deposits which could impair movability of those link arms.

In order to give the link arms sufficient stability and rigidity, but nevertheless a compact design, the link arms may have a U-shaped or L-shaped or T-shaped cross-section with a main leg of the cross-section being arranged parallel to the pivot axes of the link arms and at least one leg further of the cross-section being arranged perpendicular thereto. Although such U-shaped or L-shaped or T-shaped cross-section is prone to catch hair dust and deposits, it nevertheless can be easily cleaned as the link arms are positioned uncovered between the shaver head and handle. Consequently, a very compact and lightweight, but nevertheless rigid and stable design can be used without sacrificing maintenance and cleaning.

In addition to the aforementioned elements of the support structure, in particular the link arms of the four-joint linkage, a drive transmitter may bridge the gap between the handle and the shaver head, wherein such drive transmitter may connect a drive unit accommodated in the handle to the at least one cutter element of the shaver head. More particularly, such drive transmitter may include a shaft or shaft-like elongated drive element extending from the handle into the interior of the shaver head. Such drive transmitter may be uncovered at least partially or it may be received within a sleeve-like, elongated transmitter housing extending through said gap.

Thus, when the support structure includes the aforementioned pair of link arms, three elements may bridge the handle and shaver head, namely said pair of link arms and the drive transmitter. According to an aspect, said drive transmitter may extend separately and spaced apart from said link arms through the gap between the handle and the shaver head to allow for cleaning of each of those elements. So as to achieve a compact arrangement of these three separate elements, the drive transmitter may be arranged in the middle or center between said pair of link arms. However, the drive transmitter also may be offset from the plane containing the link arms.

Said link arms, with their longitudinal axis, may be arranged in a common plane which may be substantially parallel to the longitudinal axis of the handle. However, according to an alternative aspect, said link arms may be positioned inclined vis-à-vis the handle's longitudinal axis. More particularly, the common plane containing the longitudinal axis of the link arms may be inclined towards a front side of the handle at an acute angle to the handle's longitudinal axis, wherein such acute angle may range from 5° to 40° or from 10° to 30° for example. Such inclination of the link arms to the front side of the shaver improves an ergonomic handling. In particular, the tilt axis provided by such inclined link arm arrangement may extend at an acute angle to the longitudinal axis of the handle, wherein such acute angle may range from 60° to 85° or 70° to 80° for example, thereby allowing tilting of the shaver head contacting the skin to be shaved without non-normal hand positioning.

According to an aspect, the at least one cutter element of the shaver head may be driven by means of a drive unit comprising an electric motor or a magnetic-type linear motor which may be accommodated within the shaver housing forming the handle. Such motor in the handle may be connected to the cutter element in the shaver head by means of a drive train comprising the above-mentioned elongated transmitter extending into the shaver head. For example, the drive train may include a shaft rotated by the motor in an oscillating manner, wherein such shaft may extend from the handle into the shaver head, thus passing the support structure allowing the shaver head to tilt and/or swivel relative to the handle.

Such drive train passing the support structure, in particular the aforementioned four-joint linkage, may extend in a central region of the handle and/or shaver head, wherein it may extend through a region between the aforementioned link arms of the four-joint linkage. In other words, the link arms may be positioned on opposite sides of the drive train and/or may sandwich the aforementioned drive shaft or elongated transmitter between them. In the alternative, the link arms can be provided on one side of the drive train or transmitter. For example, the link arms may be offset in the direction of the axis of rotation defined by the link arms so that the drive train passes the support structure on one side of the link arms. In addition or in the alternative, the link arms also could be offset relative to such transmitter in a direction perpendicular to the axis of rotation defined by the link arms.

So as to transform the rotatory oscillation of such shaft as mentioned before into a linear oscillation of the at least one cutter element, a crank arm may be attached to the shaft, wherein such crank arm may be positioned within the shaver head and/or may support at least one drive pin for driving the cutter element. For example, such drive pin may extend substantially parallel to the shaft and may be fixedly attached to the crank arm to extend eccentric with regard to the shaft axis. When the crank arm, in its neutral position, extends substantially perpendicular to the desired linear oscillation of the cutter element, such drive pin is moved along a curved path tangential to the desired cutter element oscillation and thus, executes a nearly linear oscillation.

The axis of rotation defined by the four-joint linkage may substantially extend in parallel with the pivot axes of the link arms and the head/handle joints thereof. In particular, the head joints and handle joints of the link arms may be pivotably connected to the shaver head part and the handle or base part thereof, wherein all pivot axes defined by such head joints and handle joints may extend substantially parallel to each other and/or substantially perpendicular to the longitudinal axis of the elongated link arms.

When the four-joint linkage defines a tilting axis transverse to the handle's longitudinal axis and to the cutter oscillation axis, such tilting axis does not necessarily extend exactly perpendicular to the common plane defined by the link arms and/or to the longitudinal axis of the handle, but may be slightly inclined at an acute angle to said common plane and/or the longitudinal axis of the handle. For example, such tilting axis may extend at an angle ranging from 75° to 89° relative to said common plane and/or to the longitudinal axis of the handle, wherein, however, it is also possible to have an exactly perpendicular arrangement with the tilting axis extending at an angle of 90° relative to said common plane and/or to the longitudinal axis of the handle.

Irrespective of the inclination of the tilting axis relative to the longitudinal axis of the handle, the link arms of the four-joint linkage providing for such tilting axis for the shaver head may be arranged in different positions and/or orientations. For example, the link arms may be positioned in said common plane which may be offset relative to the longitudinal axis of the handle and/or a center plane containing such longitudinal axis of the handle and/or relative to a drive train, wherein such offset from the longitudinal axis may be given in the direction of the tilting axis.

In order to achieve a responsive self-adjustment of the angular position of the cutter element to the skin and to avoid collisions between the drive train for driving the cutter element and the support structure, the pair of link arms of the four-joint linkage may be arranged in an upright, standing configuration where the head joints of the link arms connected to the shaver head part are further away from the handle than the handle joints of the link arms connected to the handle or a base part connected to such handle.

Such standing link arm configuration does not only give the drive train more space to extend in the region of the support structure, but also improves the shaver head kinematics to allow angular adjustment of the shaver head under less contact pressure from the skin to be shaved as the standing link arms are more willing to leave its position than hanging pendulum arms. In addition, such standing link arm configuration allows for an improved arrangement of the polhode or path along which the instantaneous center of rotation moves when rotatorily displacing the shaver head. Due to the aforementioned standing arrangement of the link arms of the four-joint linkage, there is enough space in the region of the shaver head for such transmitter structure, wherein the rotatorily oscillating shaft may extend between the link arms.

Contrary to a hanging or pendulum arrangement of the link arms where—when considering the shaver in an upright position with the shaver head above the handle—the upper ends of the link arms are connected to the handle and the hanging lower ends of the link arms are connected to the shaver head, such standing configuration provides for additional space that can be used for the drive train, and for a better kinematics of the shaver head support, and makes cleaning of the neck of the shaver between the handle and shaver head easier. As in such standing configuration—when considering the aforementioned upright position of the shaver—the lower end portions of the link arms are connected to the handle or base part and the upper end portions of the link arms are connected to the shaver head part, the handle or base part does not need to extend deeply into the shaver head to reach the upper ends of the link arms what considerably saves space in the region of the shaver head, thus giving more freedom and space to the drive train extending through the shaver head. In addition, the standing configuration allows for easy cleaning and a shaver head kinematics giving a quicker response to pressure onto the functional surface contacting the skin contour.

In particular, the link arms of the four-joint linkage may be configured to define the instantaneous center of rotation moving along a path extending through and/or adjacent to said cutter element. Due to such path of the instantaneous center of rotation extending very close to the functional surface of the cutter element, frictional forces due to sliding of the shaver along the skin to be shaved, do not cause undesired angular movements of the shaver head as such frictional forces have only short lever arms relative to the instantaneous center of rotation. On the other hand, pressure forces onto the functional surface of the shaver head which are mainly effective transverse to or perpendicular to such functional surface make the shaver head adjust its angular position to follow the contour of the skin.

The geometry of the link arms may be chosen such that the path of the instantaneous center of rotation, when considering the working range of the shaver head's movements and rotation relative to the handle, which working range is usually limited, is only slightly curved and/or has a flat or shallow contour so that the instantaneous center of rotation stays close to the cutter element, in particular to the functional surface of such cutter element, what keeps the lever arm of frictional forces small when the shaver head is moved along the skin. More particularly, said path of the instantaneous center of rotation may form a convex curve which may have its summit or vertex positioned in the region of the cutter unit in the center thereof. For example, the link arms may be configured such that the entire path along which the instantaneous center of rotation moves when rotating the shaver head in its working range, i.e. between its maximum end positions, may extend within the shaver head. More particularly, at least a center section of said path, for example +/−one third of the path's length from the center thereof, may extend in an upper half of the shaver head, wherein such upper half means the half of the shaver head further away from the handle.

In order to achieve a higher stability of the shaver head in the region around its neutral position and/or to allow for easier further rotation after an initial rotation has been effected, the four-joint linkage may be configured to have the instantaneous center of rotation move further away from the diving side of the shaver head on which side the shaver head dives towards the handle when rotating about the axis defined by the four-point linkage. For example, when the shaver head is tilted or swiveled so that—when viewing the shaver head in the direction of the swivel or tilting axis—a right side end of the shaver head moves towards the handle, the instantaneous center of rotation moves towards the left side end of the shaver head. Due to such movement of the instantaneous center of rotation towards the non-diving, opposite end, the lever arm of tilting forces increases due to the movement of the instantaneous center of rotation. For example, when the instantaneous center of rotation moves towards the left end side of the shaver head, the entire portion of the contact surface positioned on a right side of the instantaneous center of rotation has a lever arm causing the shaver head to further rotate about the instantaneous center of rotation.

The four-point linkage may be provided to allow for tilting of the shaver head about a tilting axis that extends substantially transverse to the longitudinal axis of the handle and transverse to a main axis of the shaver head, wherein such main axis of the shaver head may extend parallel to the longer side surfaces of the shaver head and/or parallel to the reciprocating axis of the cutter element and/or parallel to the longitudinal axis of the elongated cutter element itself. For example, when the shaver head has a substantially—roughly speaking—elongated block-like shape with a pair of larger side surfaces neighboring the functional surface and a pair of smaller side surfaces neighboring the functional surface and the larger side surfaces, the aforementioned oblong main axis may extend parallel to the larger side surfaces and the functional surface. Having defined the main axis of the shaver head in such way, the aforementioned tilting axis may be defined to extend substantially perpendicular or transverse to a plane defined by the handle's longitudinal axis and said main axis of the shaver head.

In the alternative or in addition, the aforementioned four-joint linkage also may be provided to define a swivel axis for the shaver head, which swivel axis extends substantially perpendicular to the handle's longitudinal axis and parallel to the aforementioned main axis of the shaver head.

According to an aspect, the four-joint linkage allowing for tilting of the shaver head may support a shaver head part such as a shaver head frame that may tilt relative to the handle about the tilt axis defined by the four-joint linkage and the pair of link arms thereof, wherein such tiltable shaver head part pivotably supports a further shaver head part such as a cutter element support part which may swivel about the swivel axis defined by such pivot bearing. In other words, the swivel support or swivel bearing is tiltably supported by the four-joint linkage.

In the alternative, it also would be possible to have the base part to which the link arms of the four-joint linkage are connected with their handle joints, pivotably supported relative to the handle so that said base part may swivel about the swivel axis defined by such pivot bearing. In such configuration, the four-joint linkage allowing for tilting movements of the shaver head may swivel relative to the handle.

When the shaver head is supported for swiveling about a swivel axis and tilting about a tilting axis, the support structure may be configured to have the swivel axis and the tilting axis positioned closely to each other and/or close to the functional surface of the shaver head and/or close to the cutter element. In particular, the swivel axis may be defined by the support structure to extend through the cutter element and/or adjacent to the functional surface of the cutter element so that frictional surfaces transverse to the swivel axis—when moving the functional surface of the cutter head along the skin to be shaved—have no or no significant or only small lever arms relative to such swivel axis so that such frictional forces do not cause undesired swiveling of the shaver head. Such swivel axis may be defined by a pivot bearing as mentioned before what keeps the swivel axis in the desired position relative to the cutter element.

These and other features become more apparent from the examples shown in the drawings. As can be seen from FIG. 1, shaver 1 may have a shaver housing forming a handle 2 for holding the shaver, which handle 2 may have different shapes such as—roughly speaking a substantially cylindrical shape or box shape or bone shape allowing for ergonomically grabbing or holding the shaver, wherein such shaver handle 2 has a longitudinal axis 20 due to the elongated shape of the handle, cf. FIG. 1.

More particularly, the handle 2 may have a cross-sectional shape which is rounded or circular or oval or elliptical, wherein mixtures of those shapes are possible. Irresectable of the cross-sectional shape, the cross-section may continuously increase from one end of the handle to the other one thereof.

On one end of the handle 2, a shaver head 3 is attached to the handle 2, wherein the shaver head 3 may be slewably supported about a swiveling axis 7 and about a tilting axis 11 which swiveling and tilting axes 7 and 11 may extend substantially perpendicular to each other and perpendicular to the aforementioned longitudinal handle axis 20.

When considering an oblong main axis 40 of the shaver head 3, the swivel axis 7 may extend parallel to such main axis 40, whereas the tilting axis 11 may extend perpendicular to such main axis 40. Such main axis 40 may be considered to extend in parallel to the larger side surfaces 55 and 57 of the shaver head 3 and/or in parallel with a longitudinal axis of the elongated cutter elements 4 and/or substantially perpendicular to the longitudinal handle axis 20. As can be seen from FIG. 1(*b*), the shaver head 3 may have a—roughly speaking—elongated box-like shape with a pair of larger side surfaces 55 and 57 arranged on opposite sides of the functional surface 56 which is facing away from handle 2. The shaver head 3 further has two smaller side surfaces 58 and 59 neighboring the aforementioned larger side surfaces 55 and 57 and the functional surface 56. As can be seen from FIG. 1(*a*), the aforementioned box shape of the shaver head 3 does not mean—at least not necessarily—a mathematical cuboid or parallelepiped, but may include rounded edges and/or rounded corners and/or slightly convex and/or concave surfaces. Nevertheless, the shaver head 3 forms a—roughly speaking—elongated, substantially rectangular, box-like body having an extension in the direction of the aforementioned main axis 40 significantly longer than the extension in the two directions perpendicular thereto. For example, the shaver head's length along said main axis 40 may be larger than 130% or larger than 150% or larger than 200% of the shaver head's width measured perpendicular to the main axis 40 and transverse to the handle's longitudinal axis 20.

The shaver head 3 may include a pair of elongated cutter units 100 each comprising an elongated cutter element 4 that can be driven in a reciprocating manner along reciprocating axis 8 which may extend parallel to the aforementioned main axis 40. Said cutter elements 4 may cooperate with and reciprocate under shear foils 5 covering said cutter elements 4.

The said cutter elements 4 may be supported movably relative to the shaver head 3 or, more particularly, relative to a shaver head frame 6 such that, on the one hand, the cutter elements 4 may swivel and tilt together with the shaver head 3 about swiveling and tilting axes 7 and 11 and, on the other hand, the cutter elements 4 may oscillate along a cutting or reciprocating axis 8 relative to the shaver head frame 6, wherein said reciprocating axis 8 may extend parallel to the longitudinal axis of the elongated cutter elements 4. In addition to these degrees of freedom, the cutter elements 4 may be movable relative to the shaver head frame 6 along and/or about additional axes. For example, the cutter elements 4 may dive into the shaver head 3, i.e. displaced along an axis substantially parallel to the longitudinal handle axis 20 when the shaver head 3 is in a position aligned therewith.

The shaver head 3 may include further functional elements such as a long hair cutter which may be arranged between the aforementioned pair of cutter elements 4 or along a side thereof. Furthermore, it should be said that in addition to or in the alternative to the aforementioned elongated cutter elements 4 oscillating linearly, it also would be possible to provide for cutter elements of the rotatory type which may rotate or rotatorily oscillate.

As mentioned before, the cross-section of the handle 2 may increase from one end to the other end thereof. More particularly, the cross-section may become larger towards the shaver head 3, wherein the cross-section may continuously and/or slightly increase from the bottom face 207 to the top face 202 of the handle.

As can be seen from FIG. 1(*b*), the handle 2 may include a swelling 205 at its upper end portion neighboring the shaver head 3, wherein such swelling 205 may have a smooth convex contour and may form a sausage-like projection extending substantially transverse to the handle's longitudinal axis across the backside 206 of the handle 2 so as to snuggly fit onto the forefinger or onto the edge of the metarcarpus adjacent thereto. The projection height 209 transverse to the longitudinal axis 20 may range from 3 to 20 mm or 5 to 15 mm or 10 to 20 mm for example.

Figure 2A:
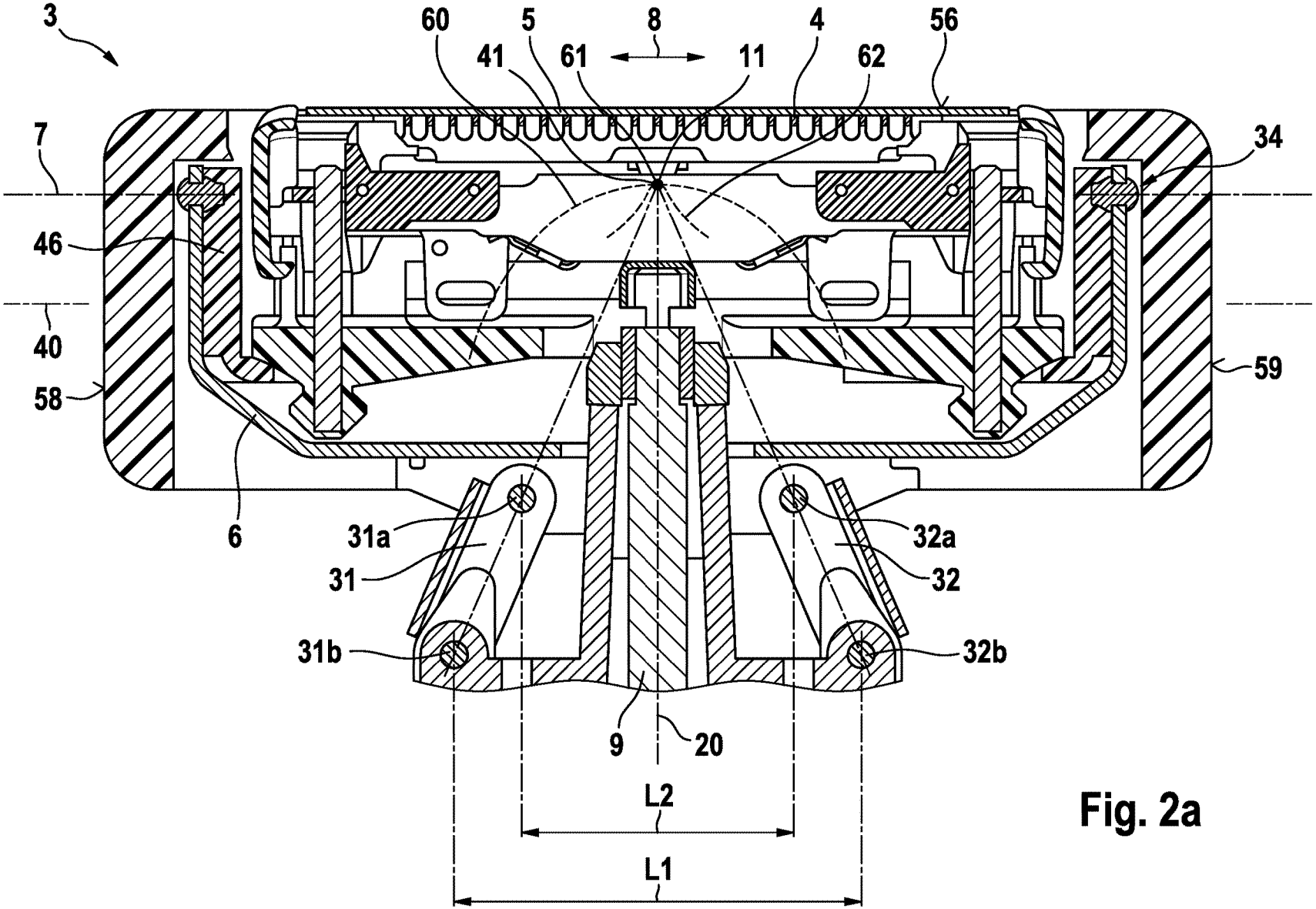
FIG. 2*a*: a partial view of a cross-sectional view of a shaver head of the present invention and the support structure thereof, wherein the shaver head in a neutral or not tilted position with the link arms of the support structure being symmetrical to and slightly inclined to a middle plane containing the longitudinal axis of the shaver.
Figure 2B:
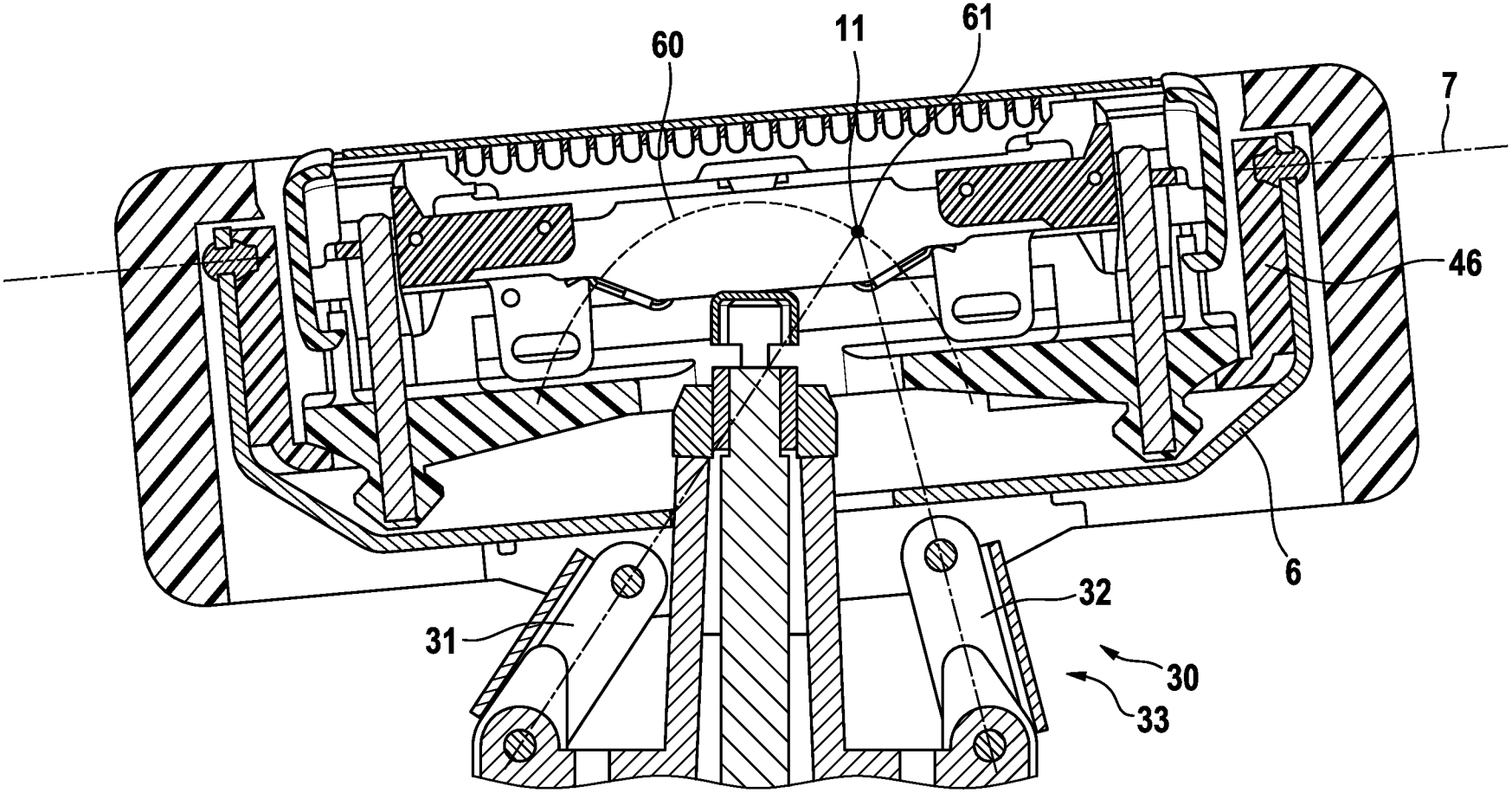
FIG. 2*b*: shows the shaver head in a tilted position with the link arms being pivoted and the shaver head, with a left side, lowered towards the handle, wherein both partial views show the shaver head's instantaneous center of rotation and the polhode thereof along which said instantaneous center of rotation moves, and the trajectory of left and right side ends of the cutter elements along which trajectories said left and right side ends move when tilting the shaver head.
Figure 3:
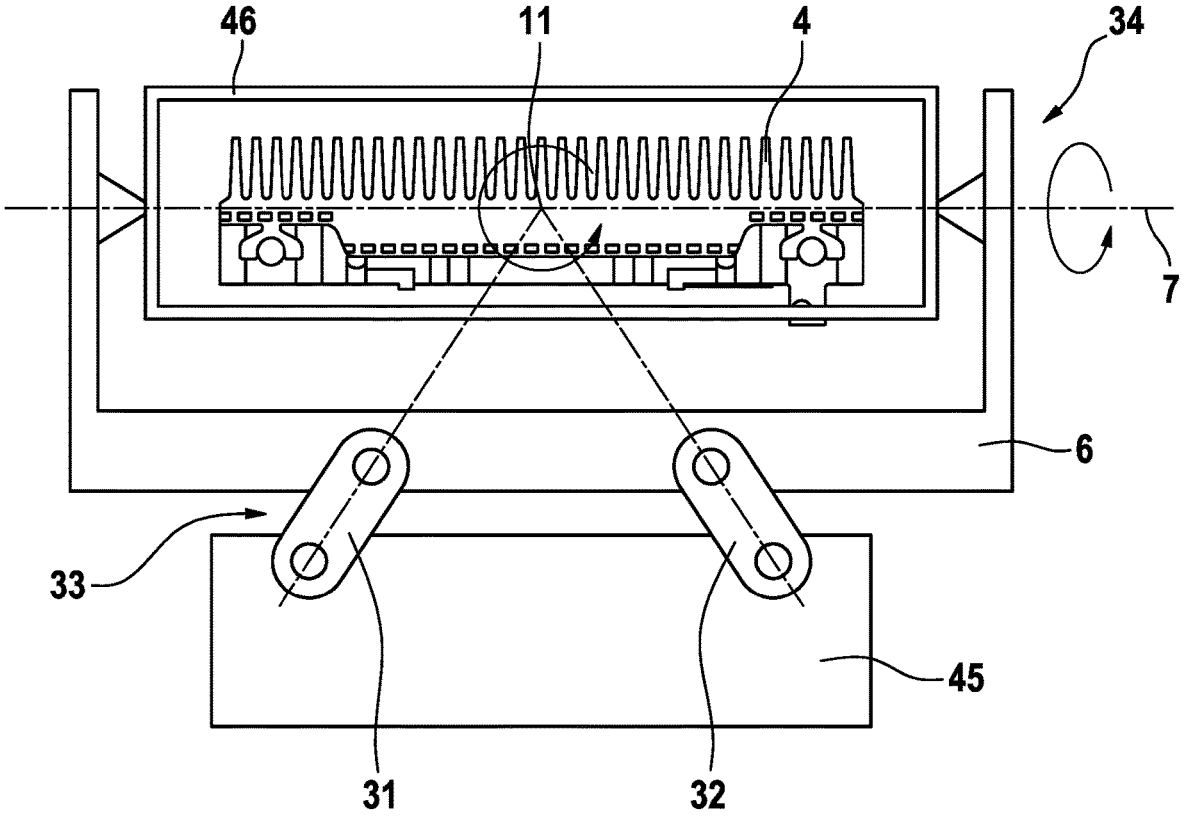
FIG. 3: a more schematic view of the support structure for the shaver head to illustrate the kinematics thereof.
Figure 5:
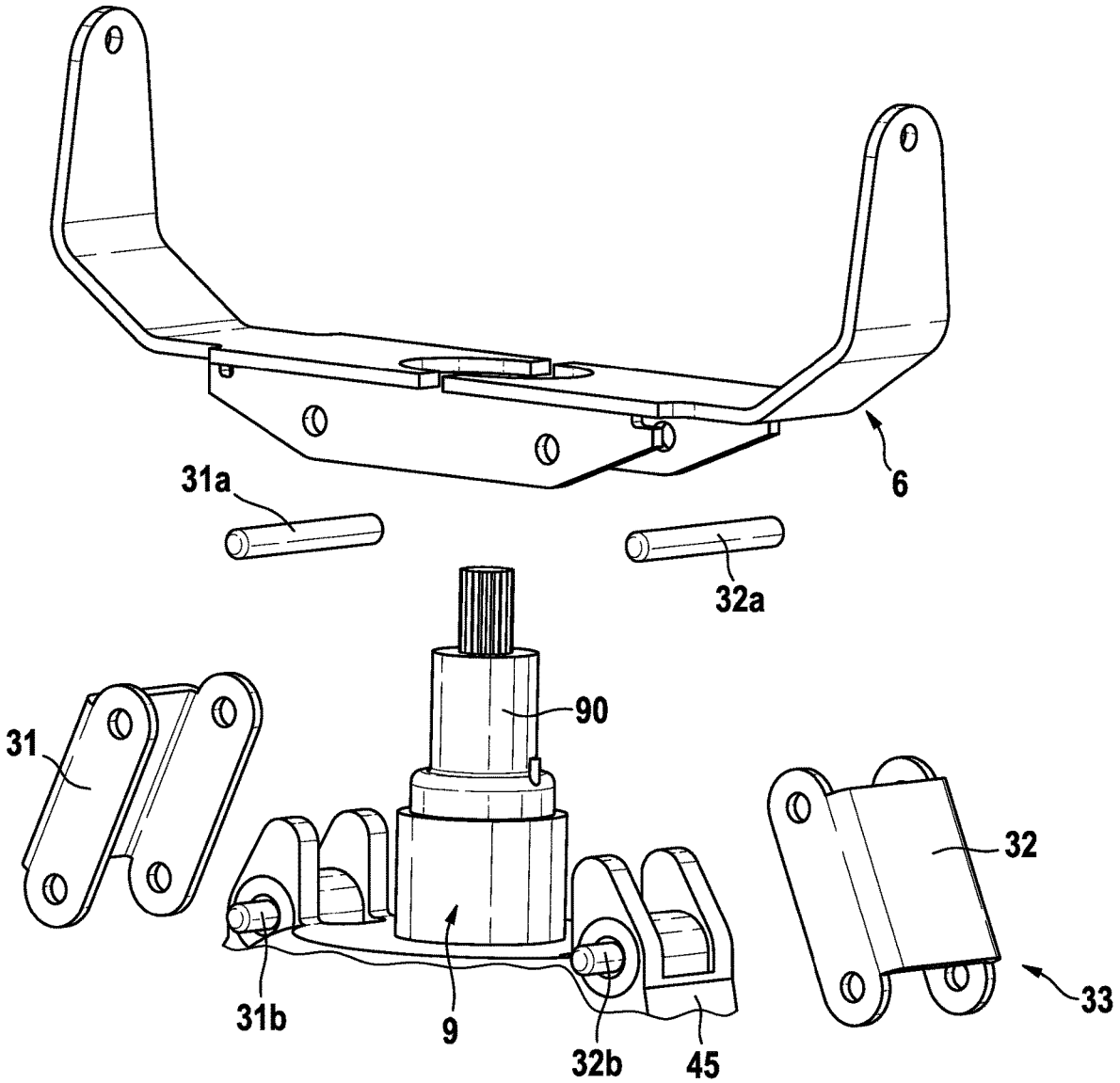
FIG. 5: a perspective explosion view of the four-point linkage of the support structure for the shaver head.

As can be seen from FIGS. 2(*a*) and 3, the shaver head 3 is supported onto the handle 2 by means of a support structure 30 which may include a four-joint linkage 33 which may comprise a pair of link arms 31 and 32 that may pivot about parallel axes. Such link arms 31 and 32 may have a bar-shaped or a frame-like structure including a U-shaped cross-section as it is shown in FIG. 5.

Said link arms 31 and 32 are arranged in an upright, standing configuration where the end portions of those link arms 31 and 32 connected to the shaver head 3 are further away from the handle 2 than the opposite end portions of those link arms 31 and 32 connected to the handle 2 or a base part 45 connected to such handle 2. In other words, when considering the shaver 1 in an upright position with the shaver head 3 above the handle 2, upper end portions of the link arms 31 and 32 are connected to a shaver head part, whereas lower end portions of the link arms 31 and 32 are connected to the handle 2 or a base part mounted thereon.

In a neutral or non-tilted position of the shaver head 3 where the main axis 40 of shaver head 3 extends substantially perpendicular to the longitudinal handle axis 20, the link arms 31 and 32 may be arranged symmetrical with regard to a center plane containing the longitudinal handle axis 20, cf. FIG. 2(*a*). More particularly, the link arms 31 and 32 may be inclined relative to such center plane at an acute angle.

As can be seen from FIGS. 2(*a*) and 3, the handle joints 31*b* and 32*b* where the link arms 31 and 32 are pivotably connected to the handle 2 or base part 45 are spaced from each other at a distance L1 that is larger than the distance between the head joints 31*a* and 32*a* where the link arms 31 and 32 are pivotably connected to the shaver head part. The ratio between distance L1 to distance L2 may vary and/or may be adapted to the length of the link arms 31 and 32 so as to achieve the desired kinematics as explained before.

As can be seen from FIG. 2(*a*), a shaver head frame 6 may be connected to the link arms 31 and 32 at the head joints 31*a* and 32*a* thereof which define pivot axes parallel to tilting axes 11. Consequently, the shaver head frame 6 may tilt relative to the handle 2 about said tilting axis 11.

Furthermore, said shaver head frame 6 may pivotably support another shaver head part such as a cutter support frame 46 to allow such cutter support frame 46 to swivel about a swivel axis 7 defined by such pivot bearing between the shaver head frame 6 and the cutter support frame 46. Such pivot bearing may include a shaft or stubble received within a hole or recess, wherein the swivel axis 7 may be fixed relative to the shaver head frame 6.

The aforementioned cutter element 4 may be supported at the cutter support frame 46, wherein the cutter elements 4 may be allowed to execute the aforementioned reciprocating drive movements along reciprocating axis 8 relative to the cutter support frame 46. In addition, the cutter elements 4 may dive relative to such cutter support frame 46 towards the handle 2.

As can be seen from FIG. 1(*c*), the link arms 31 and 32 are uncovered and accessible from the ambience as the shaver head 3 is positioned spaced apart from the handle 2. More particularly, the shaver head 3 is separated and spaced apart from the handle such that a gap 200 is defined between a bottom face 201 of the shaver head and a top face 202 of the handle 2, wherein said gap 200 forms a substantially ring-shaped contraction in the outer contour of the shaver 1 around the link arms 31 and 32 so that access to such link arms 31 and 32 is given from the ambience. Thus, a user may watch the link arms 31 and 32 moving when the shaver head 3 is tilting or slewing.

Figure 4:
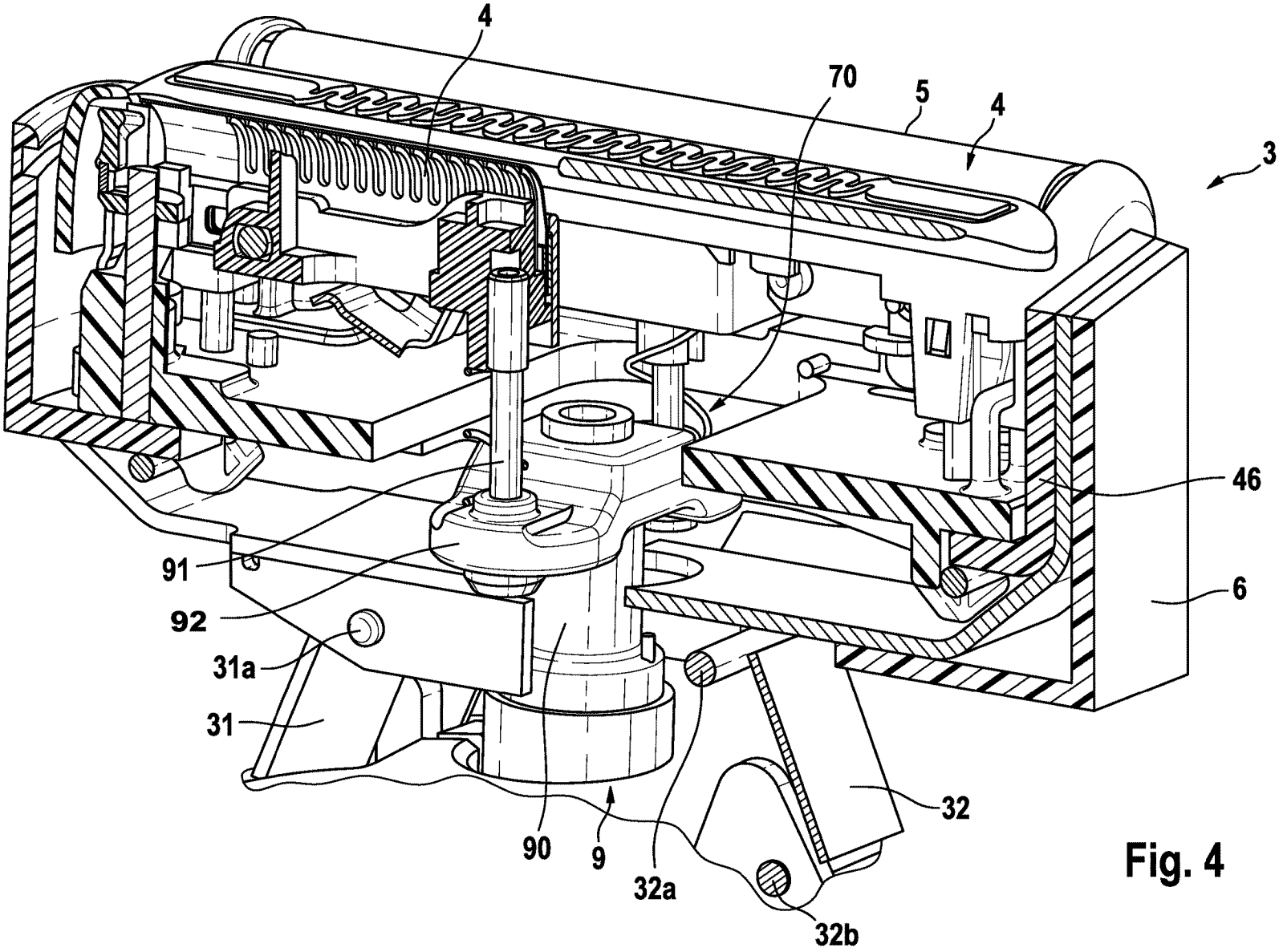
FIG. 4: a perspective cross-sectional view of the shaver head and the support structure thereof, showing the link arms of the four-joint linkage and the drive train extending from the handle through the support structure into the shaver head so as to drive the cutter elements in a reciprocating manner.

In addition to said link arms 31 and 32, said gap 200 also may be bridged by an elongated drive transmitter 9 extending from the handle 2 to the cutter element 4 in the shaver head 3 so as to connect the cutter element 4 to a motor 93 which may be accommodated in the interior of the handle 2. Such elongated drive transmitter 9 may include a shaft 90 which may be driven to rotate in a reciprocating manner, i.e.

to rotate back and forth by a certain degree. As can be seen from FIG. 4, a crank element 92 may be rotatorily fixed to said shaft 90 and accommodated inside the shaver head 3. Such crank element 92 may rigidly support a drive pin 91 for each of said cutter elements 4. Said crank element 92, in a neutral position of the shaft 90 may extend transverse to the longitudinal axis of the elongated cutter element 4 so that the drive pin 91 moves back and forth along the longitudinal axis of the cutter element 4. More particularly, such drive pin 91 executes a movement along a segment of a circle. However, as the rotational oscillation has a limited amplitude and the circular segment is tangential to the longitudinal axis of the cutter element 4, such movement may be considered to approximate a linear movement along the cutter element's longitudinal axis.

Said shaft 90 may be supported rotatably, but otherwise fixed by said handle housing, so that said shaft 90 and said drive pin 91 each define an axis having a fixed orientation relative to the handle 2.

The aforementioned elongated drive transmitter 9 in terms of the aforementioned shaft 90 may extend through the gap 200 separate from the link arms 31 and 32. Thus, three separate elements spaced apart from each other may bridge the aforementioned gap 200, namely the link arms 31 and 32 and the elongated drive transmitter 9.

The link arms 31 and 32 and the drive transmitter 9 together form a neck 203 connecting the handle 2 to the shaver head 3, which neck 203 is surrounded by said gap 200 and has a cross-sectional area significantly smaller than the cross-sectional area of the handle 2 and/or of the shaver head 3 when considering a cross-sectional plane transverse to the longitudinal axis 20 of the handle 2.

As can be seen from FIG. 1(*b*), the top face 202 of the handle 2 and the bottom face 201 of the shaver head 3 each may have a dome-shaped contour so that the aforementioned gap 200 may have its smallest width in the center of those dome-shaped bottom and top faces, wherein the width of the gap 200 may continuously increase towards the outer periphery of said bottom face 201 and/or top face 202. The smallest width of the gap 200 may be positioned between the link arms 31 and 32 and/or the transmitter 9 and said link arms 31 and 32, and/or in a center region of the shaver.

Said smallest width of the gap 200 in the center thereof may be at least 3 mm or at least 5 mm or at least 10 mm.

Said gap 200 may form a sight channel allowing a user to see through the spacing between the shaver head 3 and the handle 2. There may be at least one sight channel going from a front side 208 to a backside 206 and/or at least one sight channel going from a left side to the right side of the shaver, wherein such sight channels extend under the shaver head 3 and above the handle 2, cf. FIGS. 1(*a*) and 1(*b*).

As can be seen from part (b) of FIG. 1, the shaver head 3, with its functional surface 56 where the cutter units 100 are arranged, may be tilted towards the front side 208 of the handle 2 at an acute angle to the longitudinal axis 20 of the handle 2 which acute angle may arrange from, for example, 45° to 85°.

As can be seen from FIG. 1(*b*), the aforementioned link arms 31 and 32 also may be inclined towards the front face 208 of the handle 2. More particularly, the link arms 31 and 32, with their longitudinal axes, may be arranged in a common plane which is inclined towards said longitudinal axis 20 of the handle 2 at an acute angle 204 which may range from 5° to 40° for example. In addition or in the alternative, such common plane defined by the link arms 31 and 32 may extend substantially perpendicular to a plane tangential to the functional surface 56 of the shaver head 6 and/or defined by the cutter elements 4.

Due to the aforementioned upright configuration of the four-joint linkage 33, the shaver head 3, after tilting thereof, may be brought back into its neutral or non-tilting position by means of a biasing means 70 that urges the shaver head 3 away from the handle 2 and/or away from the base part 45. As can be seen from FIG. 4, such biasing means 70 may include a spring device urging the cutter unit away from the handle 2, wherein such spring may be positioned between the aforementioned cutter unit 100 and a drive train element for driving the cutter element 4 in a reciprocating manner. Thus, said biasing means 70 may fulfill a double function or multiple function including biasing the link arms 31 and 32 and thus, the shaver head 3 into their/its neutral, non-tilting position and allowing the cutter unit 4 to dive and/or float.

In addition or in the alternative to such diving of the cutter elements 4 relative to the shaver head structure, it also would be possible to allow for diving of the entire shaver head 3 including the cutter elements 4. For example, the aforementioned link arms 31 and 32 do not need to be connected directly to the handle 2, but they may be linked to a base part 45 which may be movably supported on the handle 2 to be moved basically along the longitudinal axis 20 of the handle 2. In other words, the base part 45 pivotably supporting the link arms 31 and 32 and thus the entire shaver head 3 may dive towards the handle 2, wherein a biasing device or spring device may be provided between the handle 2 and said base part 45 to bias or urge the base part 45 away from handle 2 and/or towards the shaver head 3 so that the shaver head 3 may dive against the biasing or spring force. In the alternative, however, such base part 45 also may be rigidly mounted on the handle 2.

As can be seen from FIGS. 2(*a*) and 3, the swivel support structure is allowed to execute the tilting movements about tilting axis 11 as the four-joint linkage 33 allowing the tilting movements is arranged between the handle 2 and the swiveling support structure 34.

As shown by FIGS. 2(*a*) and 3, the swivel axis 7 may extend through or very close to the cutter elements 4, wherein said swivel axis 7 may extend between the cutter elements 4 when a pair of cutter elements is provided. For example, the swivel axis 7 may extend in the upper half of the shaver head 3, i.e. the half of the shaver head 3 further away from the handle 2, or may extend in the uppermost quarter of the shaver head 3 or through a top portion of the shaver head 3 where the block-like cutter elements 4 are accommodated.

The tilting axis 11 defined by the four-joint linkage 33 may be positioned closely to the swivel axis 7. More particularly, the tilting axis 11 may move due to the four-joint linkage 33 and the movements of the link arms 31 and 32. As can be seen from FIG. 2(*a*), the crossing point of two virtual straight lines one of which goes through the head and handle joints 31*a* and 31*b* of one of the link arms 31 and another one of which goes through the head and handle joints 32*a* and 32*b* of the other one of the link arms 32, defines an instantaneous center of rotation 61 corresponding to tilting axis 11 which instantaneous center of rotation 61 may move along a path 60 which is sometimes referred to as polhode or centrode.

The link arms 31 and 32, in particular the length thereof and the positioning of the head joints and handle joints thereof, can be configured such that said path 60 along which the tilting axis 11 in terms of the instantaneous center of rotation 61 may move when considering the limited working range of tilting the shaver head relative to the handle during operation of the shaver, has a curved contour which is convex towards the functional surface 56, wherein such convex curve of the path 60 may have a rather shallow contour keeping the instantaneous center of rotation 61 close to the swivel axis 7 even when the shaver head 3 is tilted about tilting axis 11.

The kinematics of the shaver head 3 with regard to tilting thereof may provide for good control of contour adaption and improved handling of the shaver. In particular, the shaver head 3 shows an increased stability against tilting when the shaver head 3 is in its neutral or non-tilted position or only slightly tilted, whereas the shaver head is more easily further tilted when it has already been tilted to a certain degree. In other words, the shaver head's willingness to tilt increases with an increasing tilting angle.

This may be achieved or at least supported by the instantaneous center of rotation defining tilting axis 11 moving away from the end side of shaver head 3 at which end side the shaver head 3 dives towards the handle when tilting. For example, a right hand side of shaver head 3 may be diving due to clockwise tilting. Due to the configuration of the four-joint linkage 33 causing the tilting axis 11, more particularly the instantaneous center of rotation to move towards the left end side of the shaver head 3 along the path 60, the lever arm of a contact force urging the shaver head 3 to further tilt, gets a lever arm that increases with an increasing tilting angle. The further shaver head 3 tilts towards the right side, the further the instantaneous center of rotation moves towards the left side what increases the portion of the functional surface on which contact pressure gets a lever arm to further tilt the shaver head 3.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. An electric shaver comprising:

a. a handle, and b. a shaver head including at least one cutter unit which includes a drivable cutter element and a shear foil, c. wherein said shaver head is connected to said handle by means of a support structure, d. wherein said shaver head and/or said at least one cutter unit have an elongated contour with a main axis extending transverse to the handle's longitudinal axis and substantially parallel to a cutter oscillation axis of said at least one cutter element, e. wherein said shaver head is positioned spaced apart from said handle with a gap defined between a bottom face of said shaver head and a top face of said handle, said gap forming a peripheral contraction in the outer contour of the shaver around said support structure and giving access to the support structure bridging said gap, f. wherein said support structure includes a four-joint linkage including a pair of link arms pivotably connected, on the one hand, to the handle and, on the other hand, to the shaver head to allow for swiveling and/or tilting of the shaver head relative to the handle, g. wherein said pair of link arms extend through said gap uncovered and freely accessible via said gap with movement of said link arms being visible to a user.

2. The electric shaver according to claim 1, wherein each of said link arms has a head joint connected to a shaver head part and a handle joint connected to the handle or a base part connected thereto, said head joints and said handle joint define pivot axes extending parallel to each other and substantially transverse to a longitudinal axis of the handle.

3. The electric shaver according to claim 2, wherein said link arms are mounted in a standing configuration with the head joints of the link arms further away from the handle than the handle joints of the link arms.

4. The electric shaver according to claim 2, wherein said link arms, with their longitudinal axes which extend through said head joints and said handle joints, are arranged in a common plane which is inclined at an acute angle to the longitudinal axis of the handle, said acute angle ranging from 5° to 40° or from 10° to 30°.

5. The electric shaver according to claim 2, wherein said link arms, in a neutral or intermediate or non-tilting position of the shaver head, are arranged in a double pitch roof-like configuration with a distance of the handle joints of the link arms from each other being larger than a distance of the head joints of the link arms from each other.

6. The electric shaver according to claim 2, wherein biasing means are provided for biasing the shaver head away from the handle and/or away from the base part, thereby biasing the shaver head into a neutral or non-tilting position of the link arms and allowing for floating of the cutter unit.

7. The electric shaver according to claim 2, wherein a drive unit including a motor is accommodated within the handle, wherein a drive train connecting said motor to the cutter element includes an elongated drive transmitter extending from said handle to the cutter element in the shaver head, wherein said elongated drive transmitter includes a shaft having a shaft portion extending outside the housing of the handle, wherein said shaft portion extends in-between said pair of link arms arranged on opposite sides of said drive transmitter and/or the handle joints of said link arms define pivot axes extending on opposite sides of said shaft portion.

8. The electric shaver according to claim 1, wherein said link arms have a U-shaped or T-shaped or L-shaped cross-section.

9. The electric shaver according to claim 1, a neck which is surrounded by said gap and includes said support structure, has a cross-sectional area of less than 50% of a maximum cross-sectional area of the handle and/or of the shaver head when considering a cross-sectional plane transverse to a longitudinal axis of the handle.

10. The electric shaver according to claim 1, wherein said gap, at its smallest section, has a width of more than 3 mm or more than 5 mm, said width corresponding to the distance of the bottom face of the shaver head from the top face of the handle.

11. The electric shaver according to claim 1, wherein said gap forms at least one sight channel going from one side of the shaver to another side of the shaver opposite thereto.

12. The electric shaver according to claim 1, wherein said top face formed by a housing of the handle and/or said bottom face of the shaver head have a convex or dome-shaped contour, wherein said gap has its smallest width in the center of said top face and/or in the center of said bottom face, which width continuously increases towards an outer periphery of said top face and/or said bottom face.

13. The electric shaver according to claim 1, wherein said handle includes a swelling projection from a back side of the handle at an end portion thereof adjacent to the top face.

14. The electric shaver according to claim 1, wherein said handle has an elongated shape the cross-section of which essentially continuously increases from a bottom face thereof to the top face opposite to said bottom face.

15. The electric shaver according to claim 1, wherein said link arms are configured to define an instantaneous center of rotation moving along a path extending through and/or adjacent to said cutter element and having a curved shape which, when considering a working range of rotation of the shaver head, is convex towards a functional side of the shaver head to be contacted with the skin to be shaved, and/or are configured to define an instantaneous center of rotation of the shaver head moving further away from a diving side of the shaver head on which diving side the shaver head dives towards the handle when rotating about the axis defined by the link arms.

* * * * *